US009870854B1

(12) United States Patent
Patterson

(10) Patent No.: US 9,870,854 B1
(45) Date of Patent: Jan. 16, 2018

(54) METHODS OF ASSEMBLING AND USING AN ADJUSTABLE INDUCTOR

(71) Applicant: The United States of America, as Represented by the Secretary of the Navy, Washington, DC (US)

(72) Inventor: Jesse W. Patterson, Smithfield, UT (US)

(73) Assignee: The Government of the United States of America as Represented by the Secretary of the Navy, Washington, DC (US)

( * ) Notice: Subject to any disclaimer, the term of this patent is extended or adjusted under 35 U.S.C. 154(b) by 276 days.

(21) Appl. No.: 14/804,113

(22) Filed: Jul. 20, 2015

(51) Int. Cl.
*H01F 29/00* (2006.01)
*H01F 27/00* (2006.01)
*H01F 41/02* (2006.01)

(52) U.S. Cl.
CPC ..... *H01F 27/006* (2013.01); *H01F 29/00* (2013.01); *H01F 41/02* (2013.01)

(58) Field of Classification Search
CPC ..... H01F 21/02; H01F 21/06; H01F 27/24; H01F 27/26; H01F 27/006; H01F 29/00; H01F 41/02
See application file for complete search history.

(56) References Cited

FOREIGN PATENT DOCUMENTS

| | | | | |
|---|---|---|---|---|
| CN | 201435287 | Y | * | 3/2010 |
| CN | 102306533 | B | * | 9/2012 |
| CN | 202473485 | U | * | 10/2012 |
| CN | 203325634 | U | * | 12/2013 |
| CN | 203760246 | U | * | 8/2014 |
| FR | 2339258 | A1 | * | 8/1977 |
| GB | 805930 | | * | 12/1958 |
| WO | 2009/108326 | A3 | * | 9/2009 |
| WO | 2013010455 | A1 | * | 1/2013 |

* cited by examiner

*Primary Examiner* — Carl Arbes
(74) *Attorney, Agent, or Firm* — James M. Saunders

(57) ABSTRACT

Embodiments of the invention disclose methods of assembling and using an adjustable inductor to vary inductance. An adjustable inductor, according to embodiments of the invention, includes a wire coil configured to mount on a first side of a conductive plate. The wire coil is conductive and is a plurality of windings. A core has a first portion and a second portion. The first and second portions are configured with a plurality of grooves for threading engagement with the plurality of windings of the wire coil. The threading engagement attaches the core to the plurality of windings of the wire coil. Rotating the core results in varied inductance.

12 Claims, 12 Drawing Sheets

METHODS OF ASSEMBLING AND USING AN ADJUSTABLE INDUCTOR

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to inductors and, more particularly, to adjustable inductors.

Figure 1A:
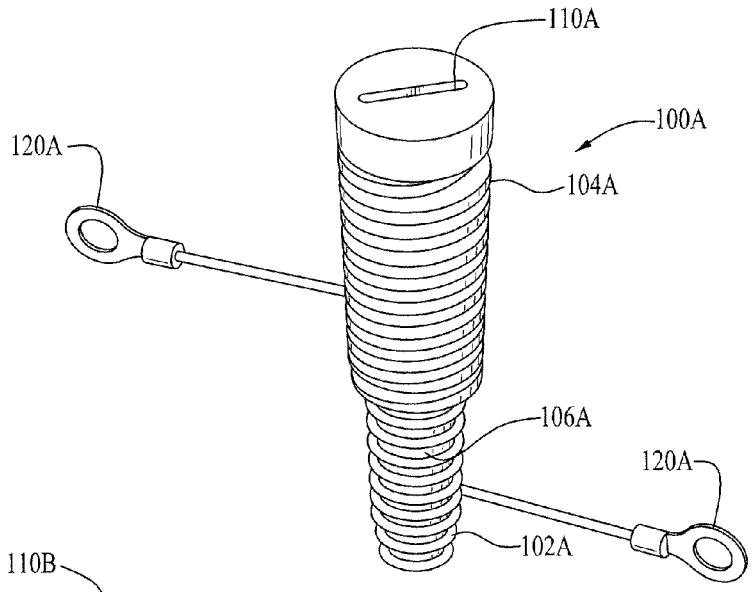
FIG. 1A is an elevated isometric view of a first assembled adjustable inductor, according to some embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

Currently available schemes for adjustable inductors typically adjust the inductance in one of three methods. First, the inductance is adjusted by moving a trace along a coil of wire. This method works when the voltage levels are low enough for open air to stand-off the voltages. Also, except for when the adjustable inductor is at its maximum inductance, there are excess wire coils that potentially introduce unwanted parasitic electrical properties. The second method is to adjust the inductance of a coil of wire by compressing or expanding the coil. Although this method allows the coil to be insulated so that it can be used in a high-voltage application, compressing the coil typically changes the inductance only a small percentage of the overall inductance. Additionally, this method deforr is the coil, which adds unwanted mechanical stress, and over time the coil may be damaged or fail to return to its original shape. A third method is to insert a rod of a specific material—typically a ferromagnetic material—into the core of the inductor to change inductance of the inductor by changing the permeability (this method is commonly used in RF tuning circuits). However, under high currents, ferromagnetic material can saturate and cause non-linear effects.

Embodiments of the invention were developed to resolve shortcomings in the art by employing an adjustable inductor, sometimes referred to as an apparatus, using a core having both non-conductive and conductive portions. Embodiments may be referred to as a non-conductor/conductor core adjustable inductor (NC3AI). The disclosed embodiments offer an adjustable inductor construction having a range of inductance for low and high voltage and current conditions with minimal unwanted parasitic or non-linear electrical properties and without mechanical deformation. Embodiments of the invention can be used to rapidly optimize/tune high power radio frequency modules and antennas. Prior to developing the adjustable inductor, optimizing high power radio frequency modules took several weeks. Optimization now only takes a few minutes with greater insight, fidelity, and agility using embodiments of the invention.

Embodiments of the invention are unique in at least three ways. A first unique feature is the use of a core that is about half non-conductive (referred to as an insulator) and about half-conductive (referred to as a conductive plug). A second unique feature is that embodiments use an electrical plane, also known as a ground plane, to shield from unwanted parasitical electrical properties. External power is applied to the apparatus. Assuming alternating current (AC), the applied voltage range is about 100 millivolts (100 mV) to about 70 kilovolts (70 kV). Embodiments of the invention are, of course, also valid for direct current (DC) conditions. Additionally, depending on application-specific conditions, a signal plane may be used instead of a ground plane. The signal plane is used when a signal is asserted on the input of the apparatus. A third unique feature is that embodiments of the invention use a screw-like construction to provide both repeatable use and insulation for high voltage applications.

Using a core that is both non-conductive and conductive provides three advantages. First, because the insulator/non-conductive portion can be made of practically any non-conductive material with sufficient voltage stand-off for the desired application, the optimal material can be selected to set the permeability of the insulator in the coil for the application. For example, applications that do not require a high current could use a ferromagnetic material to achieve a high inductance range in a compact coil, while a dielectric material could be used for high-current applications that would saturate ferromagnetic material. Second, the coil can be made in large or small physical dimensions, and thus, large or small maximum inductances. Furthermore, since the plug shorts the windings of the coil, the minimum inductance is near zero. As such, the NC3AI provides the possibility for large ranges of inductance while still being able to achieve near zero inductances. Third, because the plug sits inside the coil, as opposed to the more traditional method of having a probe outside of the coil, the plug maintains contact with all of the electrically-shorted windings of the coil to minimize unwanted parasitical electrical properties. Additionally, in some applications, the plug does not need to be a solid conductor. It can be a hollow or partially-hollow conductive material plated on another material.

Mounting the coil in an electrical plane, where the application permits, further minimizes unwanted parasitical electrical properties. The electrical plane acts as a shield between the coil and the portion of the plug that is outside of the coil.

The screw-like construction provides at least two additional advantages. First, the screw-like construction allows the NC3AI to operate without deformation. Thus, the NC3AI can repeatedly be set to different inductance values. Second, the screw-like construction allows for the insulator to protrude through the windings of the coil to provide the required stand-off voltage for the application.

Although embodiments of the invention are described in considerable detail, including references to certain versions thereof, other versions are possible such as, for example, orienting and/or attaching components in different fashion. Therefore, the spirit and scope of the appended claims should not be limited to the description of versions included herein.

In the accompanying drawings, like reference numbers indicate like elements. Reference characters 100A & 100B are used to depict embodiments of the invention. Reference character 100A is sometimes referred to as a first prototype/first embodiment and reference character 100B is sometimes referred to as a second prototype/second embodiment, according to embodiments of the invention. The apparatus 100A/100B is an adjustable inductor. The use of the letters "A" and "B" are generally used to designate between two different embodiments, including the components used with each embodiment. Other variations, of course, are possible without detracting from the merits or generalities of embodiments of the invention. Several views are presented to depict some, though not all, of the possible orientations of embodiments of the invention.

Components in Embodiments of the Invention

Components used in the apparatus 100A/100B include wire coils 102A/102B, a conductive plate 1102, mounting plates 112A/112B, insulators 104A/104B, and conductive plugs 106A/106B. The wire coils 102A/102B are conductive and made from conductive materials including, but not limited to, copper, silver, aluminum, iron, and graphene. The wire coils 102A/102B were about 0.625 inches in diameter. As is readily apparent in the figures, the wire coils 102A/102B are a plurality of windings and are sometimes referred to as such, without detracting from the merits or generalities of embodiments of the invention.

Figure 6B:
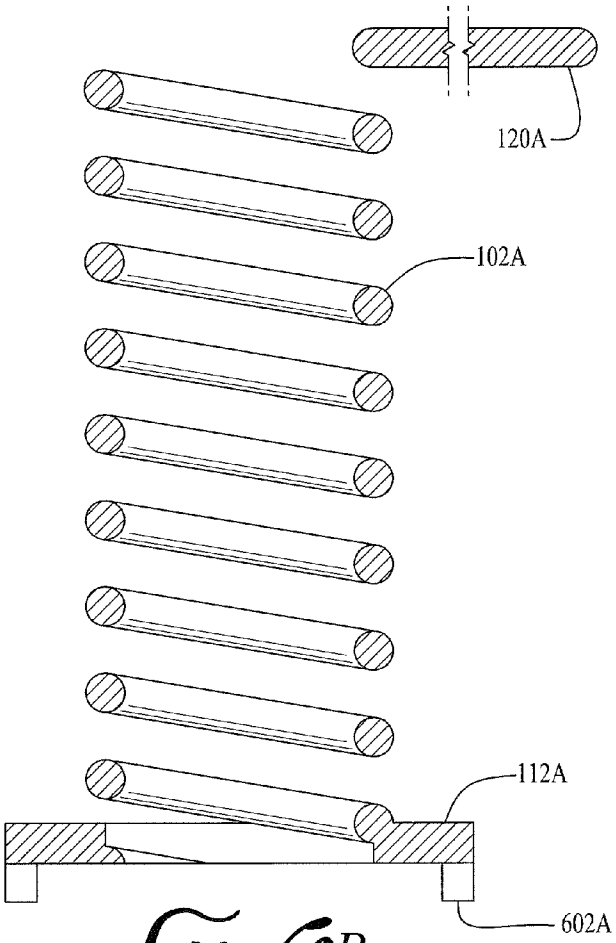
FIG. 6B is a section view of the wire coil and mounting plate (shown in FIG. 2) and perpendicular to cut plane 6B-6B of FIG. 7A, according to some embodiments of the invention.
Figure 6A:
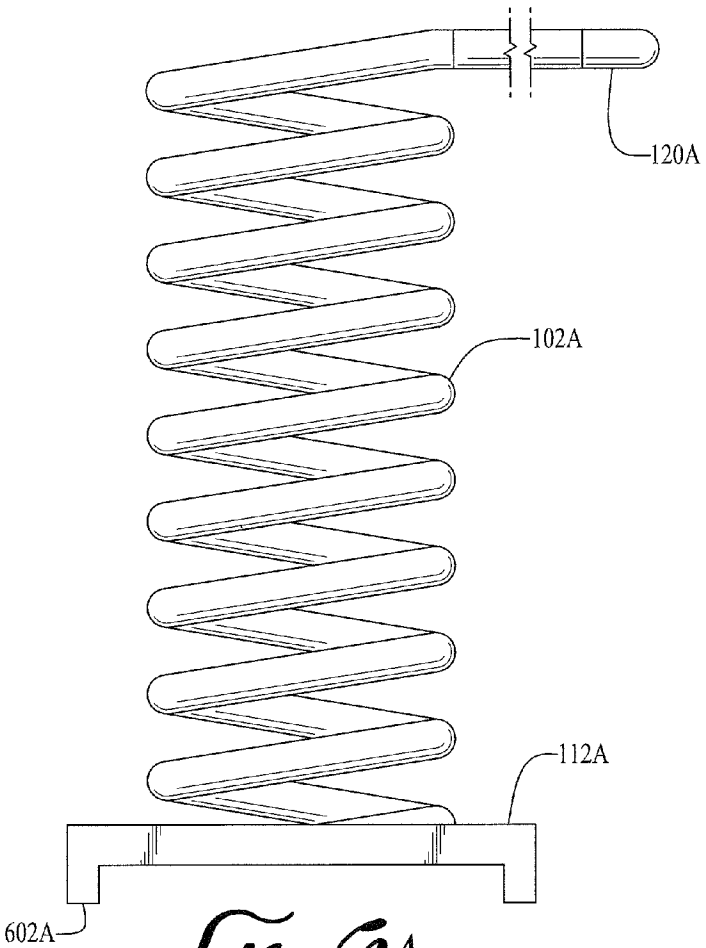
FIG. 6A is a side view of a wire coil and the mounting plate of FIG. 2, according to some embodiments of the invention.
Figure 7A:
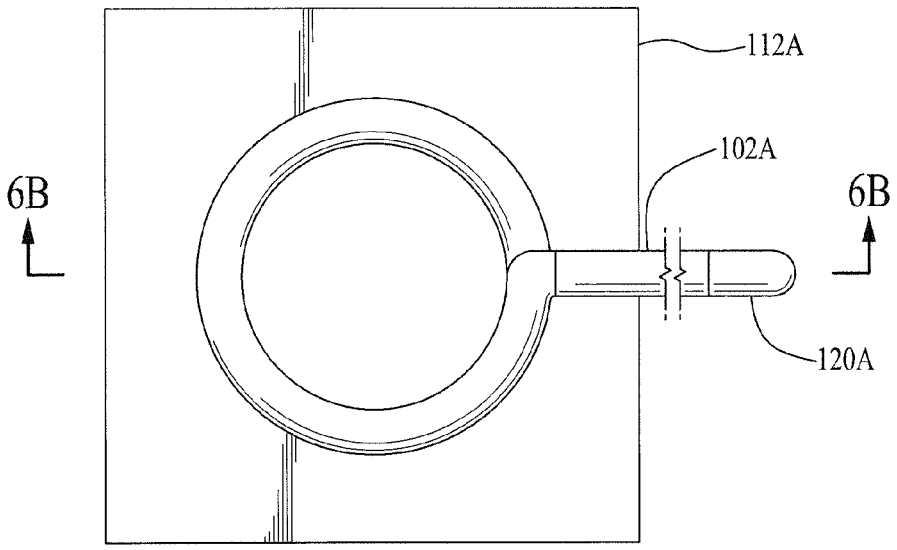
FIG. 7A is a top view of the wire coil and mounting plate (shown in FIG. 2), showing cut plane 6B-6B, according to some embodiments of the invention.
Figure 7B:
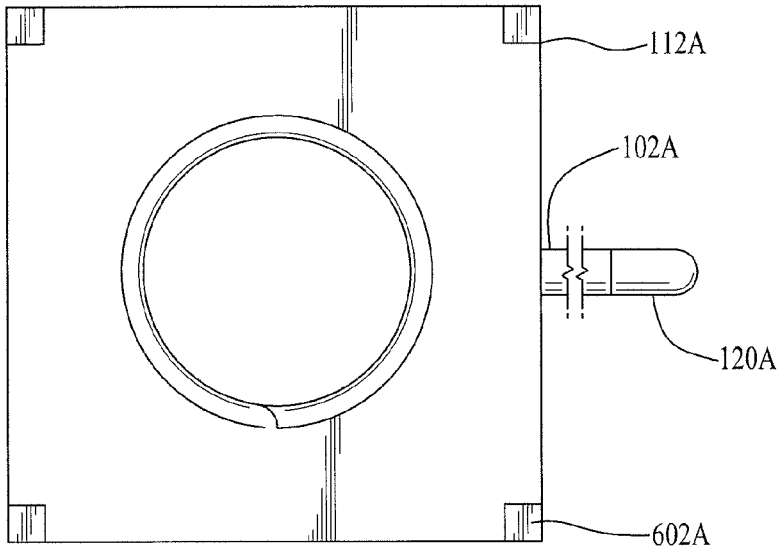
FIG. 7B is a bottom view of the wire coil and mounting plate (shown in FIG. 2), according to some embodiments of the invention.
Figure 8A:
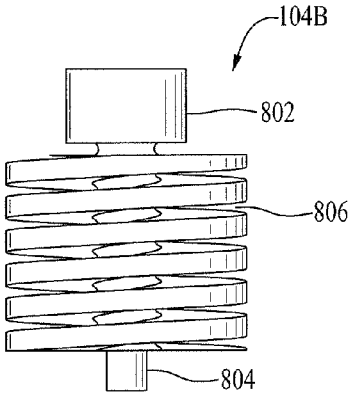
FIG. 8A is a front view of an insulator in the second assembled adjustable inductor (shown in FIG. 1B), according to some embodiments of the invention.
Figure 8B:
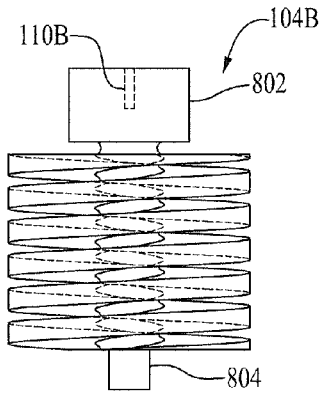
FIG. 8B, is a side view of the insulator of FIG. 8A and depicting hidden surfaces, according to some embodiments of the invention.
Figure 8C:
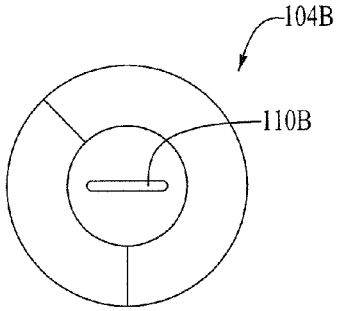
FIG. 8C is a top view of the insulator of FIG. 8A, according to some embodiments of the invention.
Figure 8D:
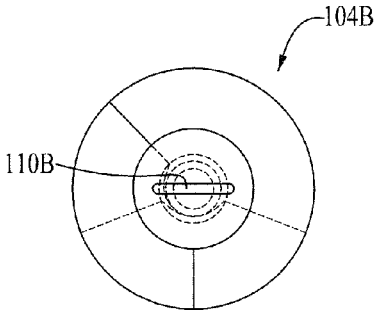
FIG. 8D is a top view of the insulator of FIG. 8A and depicting hidden surfaces of the inductor edges due to grooves configured for threading engagement with the wire coil, according to some embodiments of the invention.
Figure 8E:
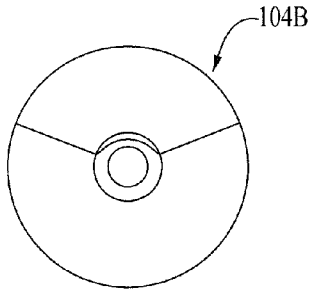
FIG. 8E is a bottom view of the insulator of FIG. 8A, according to some embodiments of the invention.
Figure 8F:
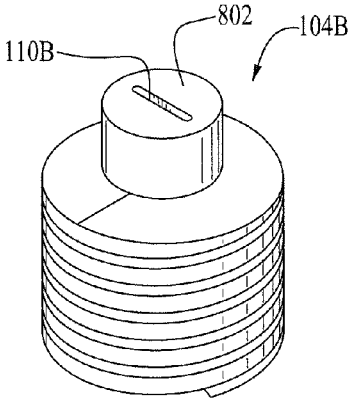
FIG. 8F is an elevated isometric view of the insulator of FIG. 8A, according to some embodiments of the invention.

The wire coils 102A/102B are typically uninsulated (bare, uncoated, exposed wire). A portion of the wire coils 102A/102B may be insulated, depending on application-specific conditions. For example, the wire ends 120A/120B may be insulated. FIG. 6A depicts the best view of a portion of wire coil 102A that may be insulated, depending on application-specific conditions, and is valid for other embodiments, as well, such as those embodiments having the wire coil designated with reference character 102B. The portion is the length of wire coil 102A from about where the leader line for reference character 120A contacts the wire coil to the break lines. Some examples of insulation that may be used on that section include, but are not limited to, a Super Corona Dope coating (thickness >2 mil) and a polyimide.

The mounting plates 112A/112B are also conductive and made from conductive materials including, but not limited to, metal, metal alloys, iron, aluminum, and copper. Similarly, the conductive plate 1102 may be made from conductive materials including, but not limited to, metal, metal alloys, iron, aluminum, and copper. The mounting plates 112A/112B were about 0.75 inches×0.75 inches square and had a thickness of about 0.0625 inches, matching the wire coil 102A/102B diameter. Prongs 602A/602B of the mounting plates were about 0.06 inches in height and about 0.05 inches×0.05 inches square in plan view.

The conductive plug 106A/106B may be made from materials including, but not limited to, copper, metal, metal alloys, and electrically conductive polymers. The conductive plug 106A/106B may be hollow or partially-hollow, depending on application-specific conditions. The insulators 104A/104B are non-conductive and may be made from non-conductive materials including, but not limited to, dielectric materials, polyethylene, ultem geralyte, ferromagnetic materials such as ferrite, and polytetrafluoroethylene (PTFE), which is a synthetic fluoropolymer of tetrafluoroethylene having numerous applications. PTFE is well known by the DuPont brand name Teflon®.

The wire coil 102A/102B may be attached to other components such as, for example, the mounting plates 112A/112B or the conductive plate 1102 by soldering, welding, or gluing, provided that conductivity is maintained. The mounting plates 112A/112B assist with structural stability of the apparatus 100A/100B. The wire coil 102A/102B, mounting plates 112A/112B, and conductive plate 1102 may also be die cast.

The insulators 104A/104B are configured with a plurality of grooves—reference characters 306 & 806, respectively. Similarly, the conductive plugs 106A/106B have a plurality of grooves—reference characters 506 & 910, respectively.

The insulator 104A in the first embodiment (first prototype) was about 1.6 inches in height, including the height of the first end 302 which was about 0.20 inches and the height of the second end 304, which was about 0.25 inches. The width and height of the second end 304 section was about 0.25 inches×0.25 inches. The overall width of the insulator 104A was about 0.64 inches. The grooves 306 of the insulator 104A had a radius of about 0.0313 inches and where spaced longitudinally (longitudinally defined by the central longitudinal axis 204) from the next adjacent groove at about 0.14 inches. The tab/slot 110A in the insulator 104A was about 0.44 inches in length, 0.15 inches in height, and about 0.063 inches wide.

The conductive plug 106A in the first embodiment (first prototype) was about 1.4 inches in height and 0.44 inches wide. The conductive plug grooves 506 had a radius of about 0.0313 inches and were spaced longitudinally (longitudinally defined by the central longitudinal axis 204) from the next adjacent groove at about 0.14 inches. The slot 508 of the conductive plug 106A was about 0.25 inches in height and 0.25 inches in width.

The insulator 104B in the second embodiment (second prototype) was about 2.0 inches in height, including the height of the first end 802 (about 0.5 inches) and the height of the second end 804 (about 0.25 inches). The first end 802 had a diameter of about 0.75 inches with a tab/slot that was about 0.25 inches in height (depth). The overall width (diameter) of the insulator 104B was about 1.5 inches. The grooves 806 of the insulator 104B had a radius of about 0.031 inches and were spaced longitudinally (longitudinally defined by the central longitudinal axis 1108) from the next adjacent groove at about 0.13 inches.

The conductive plug 106B in the second embodiment (second prototype) was about 1.4 inches in height and 0.44 inches wide (diameter). The conductive plug grooves 910 had a radius of about 0.0313 inches and were spaced longitudinally (longitudinally defined by the central longitudinal axis 1108) from the next adjacent groove at about 0.14 inches. The slot 908 of the conductive plug 106B was about 0.25 inches in height and 0.25 inches in width (diameter). A hole 906 was included in the conductive plug 106B for pressure relief to allow excess adhesive to spill out in embodiments where the insulator 104B was secured to the conductive plug by adhesive. The hole 906 was about 0.03 inches in diameter and positioned about three-quarters depth from the top of the slot 908.

First Embodiment of the Invention

Figure 11:
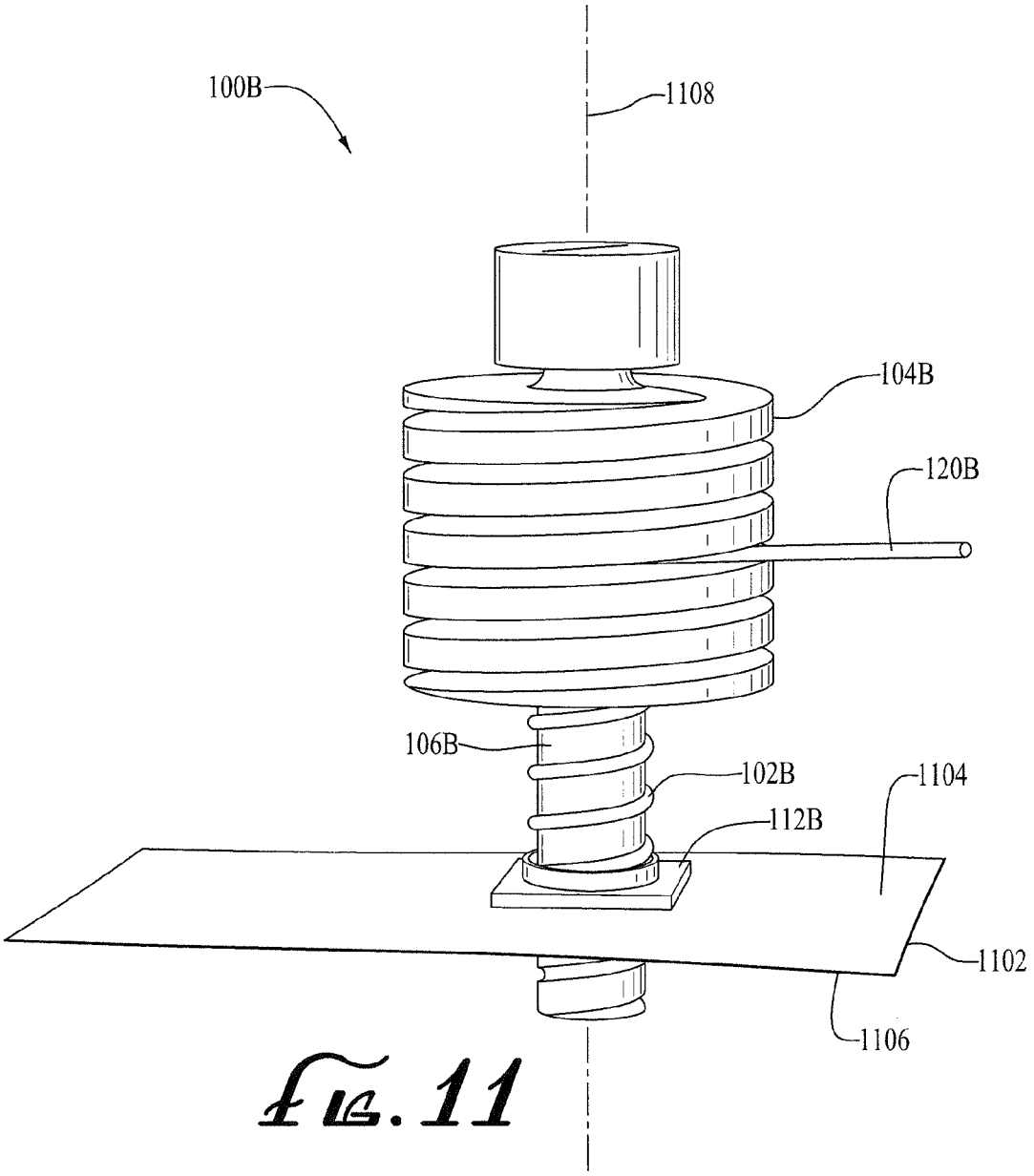
FIG. 11 is an isometric view of the inductor shown in FIG. 1B with the addition of a conductive plate, according to embodiments of the invention.

Referring to FIGS. 1A & 2 through 7B, a first embodiment of the invention is depicted. FIG. 11 is also applicable for certain components, including the conductive plate 1102. FIG. 1A is an elevated isometric view of the first assembled adjustable inductor 100A. In the first embodiment of the invention, the adjustable inductor 100A is configured to operate with a conductive plate 1102 (FIG. 11). The conductive plate 1102 has a first side 1104 and a second side 1106. An aperture (not shown) extends through both the first and second sides 1104 & 1106 of the conductive plate. The conductive plate's aperture is threaded (has a threaded portion).

A wire coil 102A is attached to the first side 1104 of the conductive plate 1102. Sometimes the attachment is called a mount. The attachment of the wire coil 102A to the conductive plate 1102 may be by soldering, weld, adhesive, or other attachment method that maintains conductivity. The wire coil 102A is a plurality of windings and, as shown in FIG. 1A, has wire ends 120A for attaching to input/output terminals. Thus, one of the wire ends 120A is considered the input to the apparatus 100A and the other wire end is considered the output. For selection purposes, the left-most wire end 120A in FIG. 1A is considered the input and the right-most wire end is considered the output.

A core is depicted as the combination of reference characters 104A & 106A. Reference character 104A is a first portion and reference character 106A is a second portion of the core. Both the first portion 104A and second portion 106A are configured with a plurality of grooves (reference characters 306/506) for threading engagement with the plurality of windings of the wire coil 102A. The threading engagement of the wire coil 102A and the first and second portions 104A and 106A attaches the core to the plurality of windings.

Figure 2:
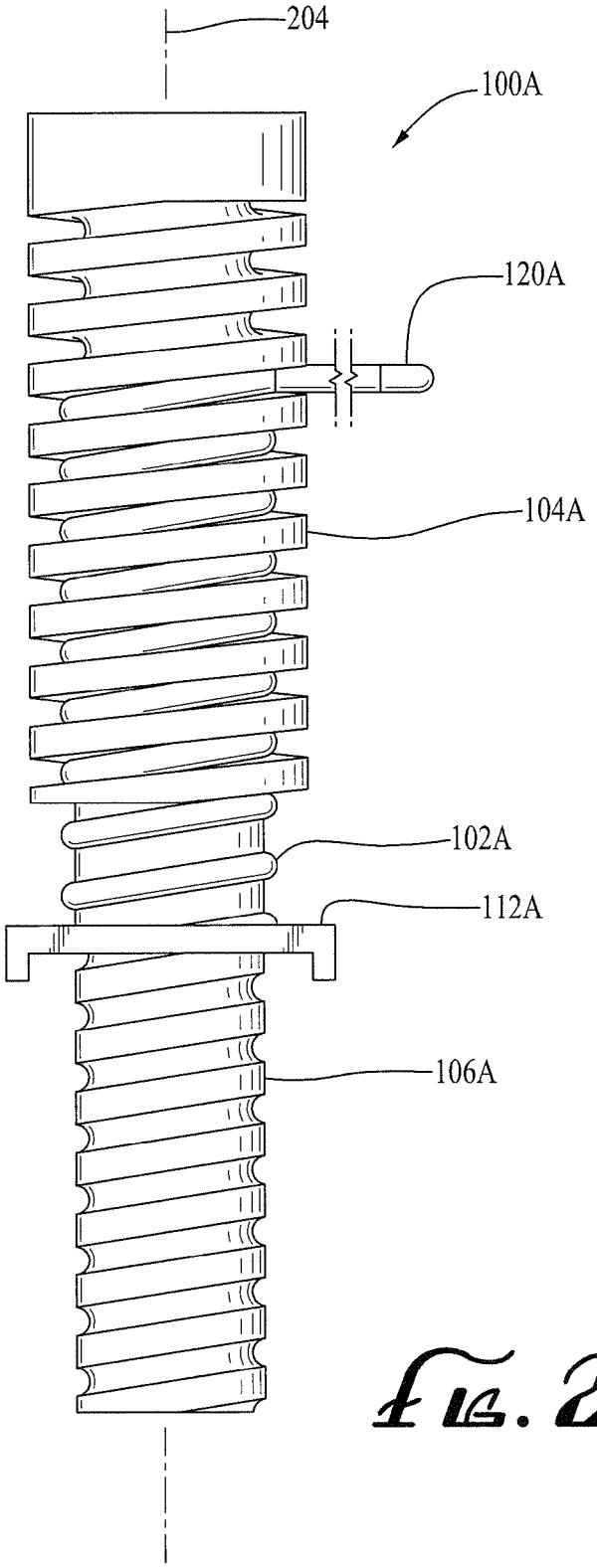
FIG. 2 is a side view of the first assembled adjustable inductor (shown in FIG. 1A) including a mounting plate, according to some embodiments of the invention.
Figure 3A:
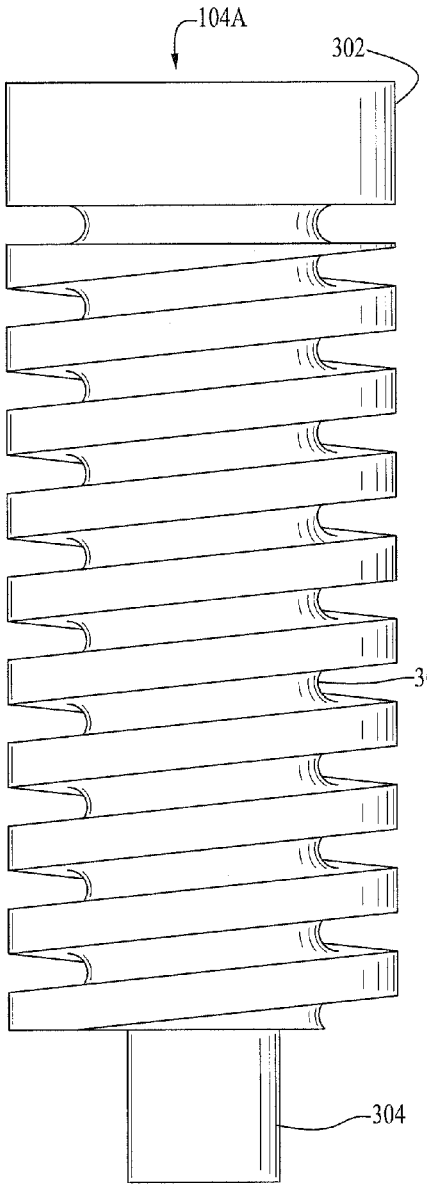
FIG. 3A is a side view of an insulator in the inductor (shown in FIG. 1A), according to some embodiments of the invention.
Figure 3B:
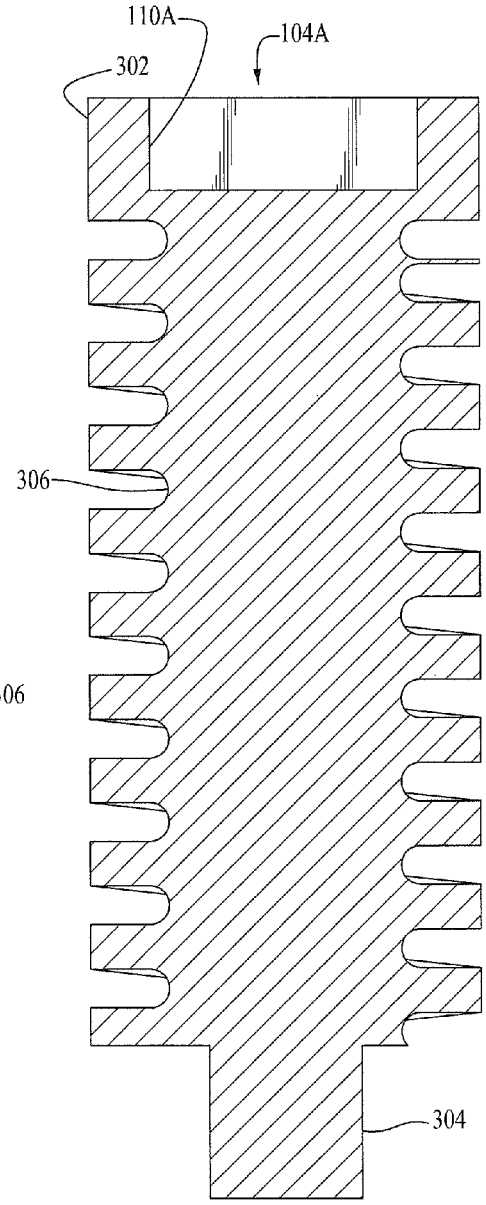
FIG. 3B is a section view of an insulator in the inductor (shown in FIG. 1A) and perpendicular to cut plane 3B-3B of FIG. 4A, according to some embodiments of the invention.
Figure 4A:
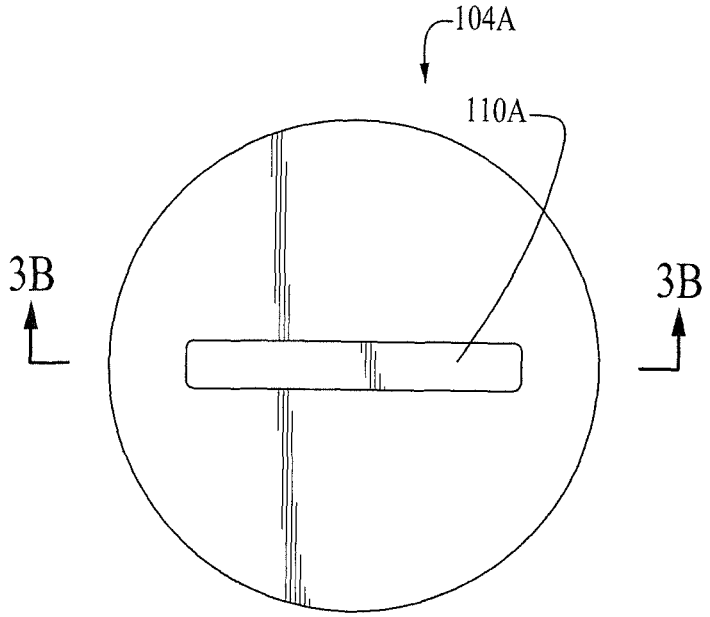
FIG. 4A is a top view of the inductor of FIG. 1A, showing cut plane 3B-3B (section 3B-3B is depicted in FIG. 3B), according to some embodiments of the invention.
Figure 4B:
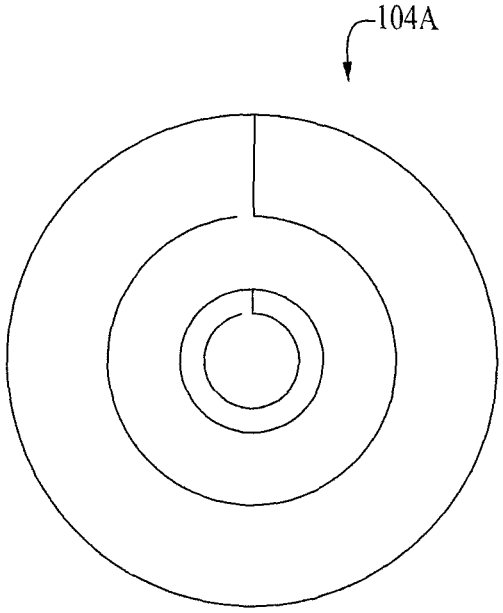
FIG. 4B is a bottom view of the inductor of FIG. 1A, according to some embodiments of the invention.
Figure 5A:
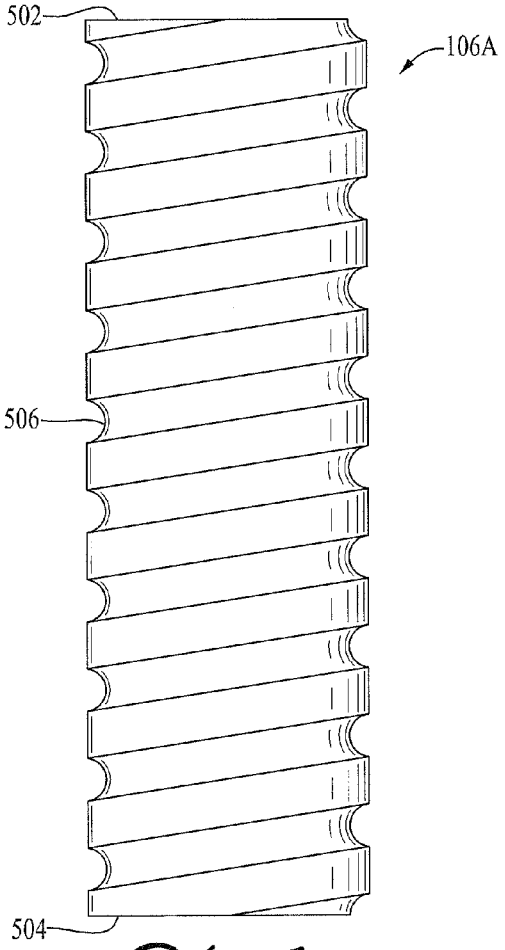
FIG. 5A is a side view of a conductive plug of the inductor (shown in FIG. 1A), according to some embodiments of the invention.
Figure 5B:
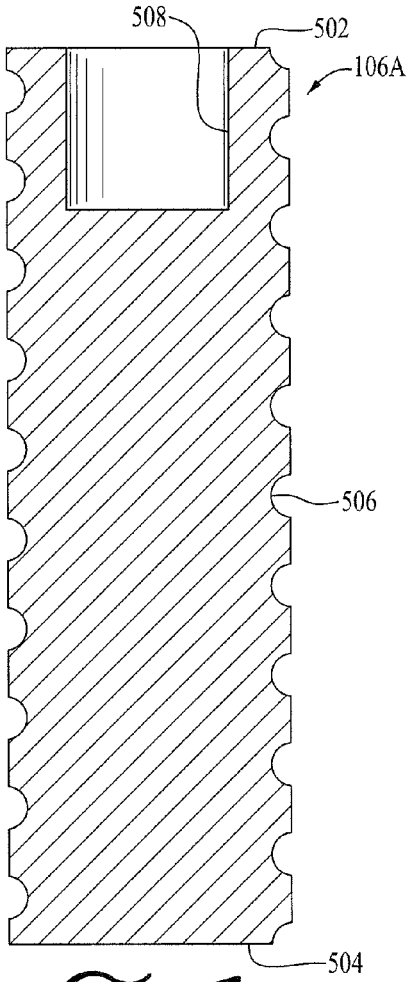
FIG. 5B is a section view of the conductive plug of the inductor (shown in FIGS. 1A and 5A) and perpendicular to cut plane 5B-5B of FIG. 5C, according to some embodiments of the invention.
Figure 5C:
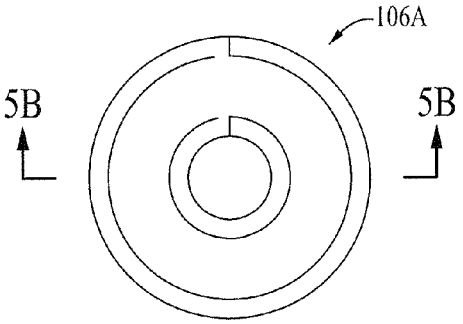
FIG. 5C is a top view of the conductive plug of the inductor (shown in FIGS. 1A and 5A), showing cut plane 5B-5B, according to some embodiments of the invention.
Figure 5D:
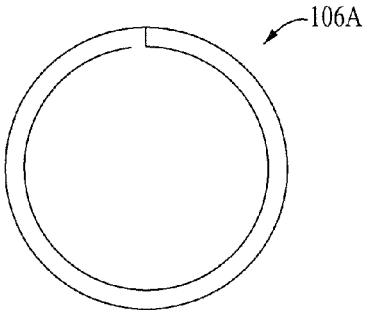
FIG. 5D is a bottom view of the conductive plug of the inductor (shown in FIGS. 1A and 5A), according to some embodiments of the invention.

As shown in FIG. 2, a central longitudinal axis 204 spans the length of the apparatus 100A and is common to the disclosed components. In FIGS. 3A & 3B, the first portion 104A is an insulator having a first end 302 and a second end 304. In FIGS. 5A & 5B, the second portion 106A is a conductive plug having a first end 502 and a second end 504. The second end 304 of the insulator 104A is fixedly-attached to the first end 502 of the conductive plug 106A. As shown in FIGS. 3A/3B & 5A/5B, the second end 304 of the insulator 104A is configured for mating engagement with the first end 502 of the conductive plug 106A, wherein upon the engagement, the second end and the first end are attached. The mating engagement occurs by inserting the second end 304 of the insulator 104A into a slot 508 (FIG. 5B) of the conductive plug 106A. The attachment can be made permanent with the addition of adhesive. Likewise, the attachment may be removably-attached using a pin and slot connection. Other attachment methods are well-known in the art.

The first end 302 of the insulator 104A is an actuator having a slot 110A, sometimes referred to as a key slot. In some embodiments, the actuator is an adjustment tab 110A, while other actuation methods are also possible including, but not limited to, a hand or machine turn-able bolt. The insulator 104A is configured to provide stand-off voltage between each of the plurality of windings of the wire coil 102A.

When the first end 302 of the insulator 104A is actuated, the core (104A/106A) is adjustable. The adjustment causes the insulator 104A and the conductive plug 106A to move in and out of the plurality of windings of the wire coil 102A.

The conductive plug 106A is configured to make electrical contact with the plurality of windings of the wire coil 102A. When electrical contact occurs, the insulator 104A provides stand-off voltage between each of the plurality of windings in electrical contact with the conductive plug 106A. This causes each of the plurality of windings in electrical contact with the conductive plug 106A to be electrically-shorted.

When the plurality of windings are electrically-shorted, current passes directly through the conductive plug 106A over the portion of the core (104A/106A) where the plurality of windings and the conductive plug are in electrical contact. When the inductor 100A is powered, current passes (flows) around the windings that are not in electrical contact with the conductive plug 106A. Thus, the portion where the plurality of windings are electrically-shorted leads to the conductive plug 106A behaving as a single thick wire such that current flows directly through the conductive plug towards the conductive plate 1102, which lowers the inductance.

As is apparent from the figures, the purpose of the conductive plug 104A is for it to be pulled into the plurality of windings. The windings that are touching the conductive plug 106A are at the same voltage. So, current flows through the conductive plug 106A instead of around each of the plurality of windings.

Second Embodiment of the Invention

Figure 1B:
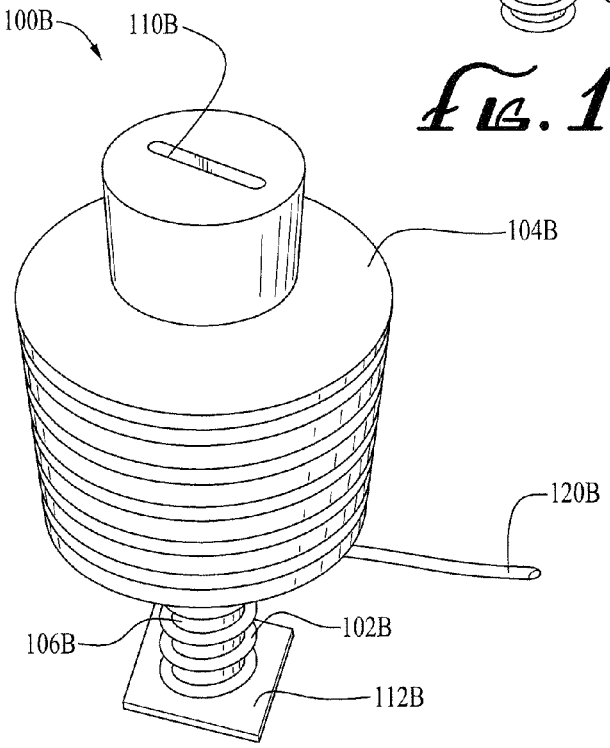
FIG. 1B is an elevated isometric view of a second assembled adjustable inductor, according to some embodiments of the invention.

The second embodiment of the invention is referenced as reference character 100B is constructed for high-pulsed power applications where the insulator is shaped to provide a high voltage stand-off or insulation to the windings of the coil. Referring simultaneously to FIGS. 1B & 8A through 11, the second embodiment is an adjustable inductor 100B that is configured to operate with a conductive plate 1102 (FIG. 11). As shown in FIG. 11, a central longitudinal axis 1108 spans the length of the apparatus 100B and is common to the disclosed components. The conductive plate 1102 has a first side 1104 and a second side 1106. An aperture (not shown in FIG. 11) extends through both the first and second sides 1104 & 1106 of the conductive plate 1102. The aperture is threaded. A mounting plate 112B has a first side 1002B, a second side 1004B, and a threaded aperture extending through the mounting plate. The mounting plate 112B is attached (mounted to) the first side 1104 of the conductive plate 1102. A wire coil 102B is a plurality of windings and, as shown in FIG. 1B, has a wire end 120B for attaching to an input terminal. Output from the apparatus 100B is through the mounting plate 112B. Thus, the mounting plate 112A may be considered as being configured to attach to an output terminal.

A wire coil 102B is attached to the first side 1002B of the mounting plate 112B. The wire coil 102B is a plurality of winding. The wire coil 102B is attached to the mounting plate 112B by soldering, weld, adhesive, or other attachment method that maintains conductivity. A core is depicted as the combination of references 104B & 106B. Reference character 104B is an insulator portion and reference character 106B is a conductive plug portion. The insulator 104B and the conductive plug 106B have a plurality of grooves 806 & 910 for threading engagement with the windings of the wire coil 102B. The threading engagement attaches the core (104B & 106B) to the plurality of windings of the wire coil 102B.

Figure 9A:
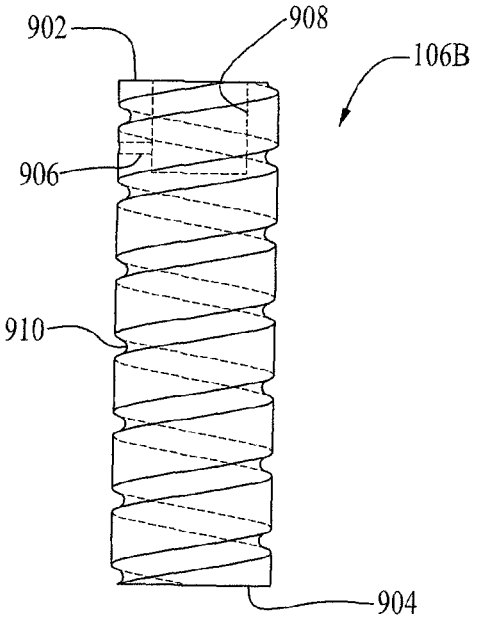
FIG. 9A is a front view of a conductive plug (shown in FIG. 1B) and depicting hidden surfaces of the conductive plug edges due to grooves configured for threading engagement with the wire coil, according to some embodiments of the invention.
Figure 9B:
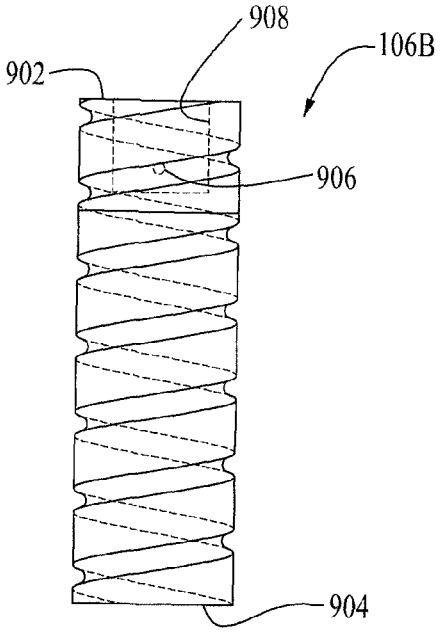
FIG. 9B is a side view of the conductive plug (shown in FIG. 9A) and depicting hidden surfaces of the conductive plug edges due to grooves configured for threading engagement with the wire coil and an attachment pin for attaching to the insulator, according to some embodiments of the invention.
Figure 9C:
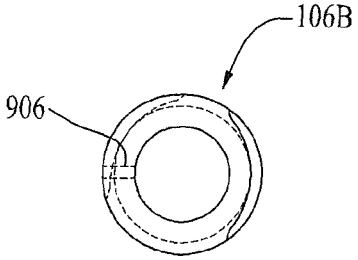
FIG. 9C is a top view of the conductive plug (shown in FIG. 9A), according to some embodiments of the invention.
Figure 9D:
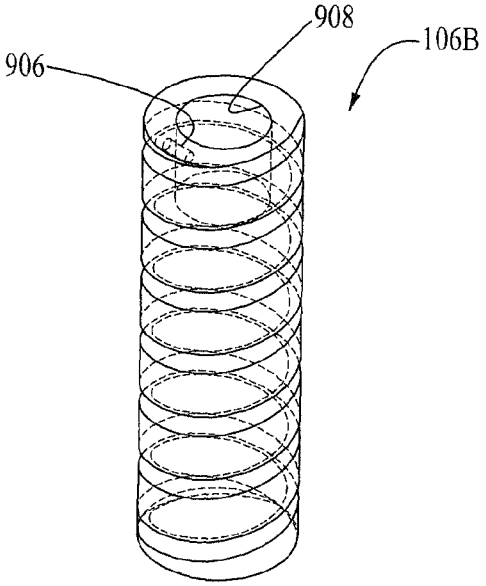
FIG. 9D is an elevated isometric view of the conductive plug (shown in FIG. 9B) and depicting hidden surfaces of the conductive plug edges due to grooves configured for threading engagement with the wire coil and the attachment pin for attaching to the insulator, according to some embodiments of the invention.
Figure 10A:
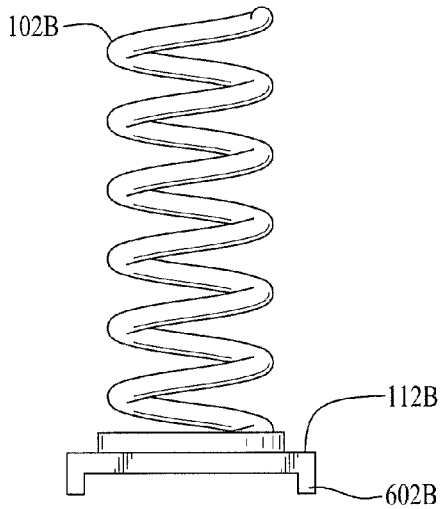
FIG. 10A is a side view of a wire coil and mounting plate in the second assembled adjustable inductor (shown in FIG. 1B), according to some embodiments of the invention.
Figure 10B:
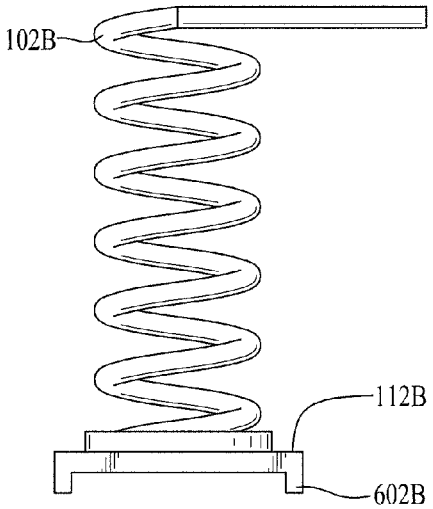
FIG. 10B is a front view of the wire coil and mounting plate in FIG. 10A, according to some embodiments of the invention.
Figure 10C:
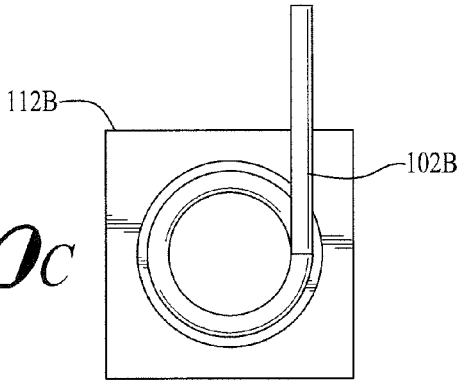
FIG. 10C is a top view of the wire coil and mounting plate in FIG. 10A, according to some embodiments of the invention.
Figure 10E:
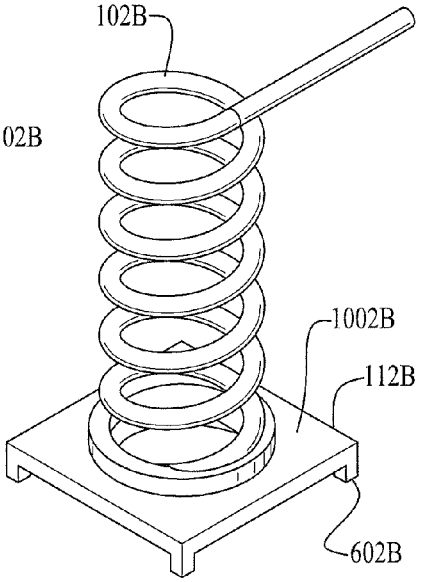
FIG. 10E is an elevated isometric view of the wire coil and mounting plate in FIG. 10A, according to some embodiments of the invention.
Figure 10D:
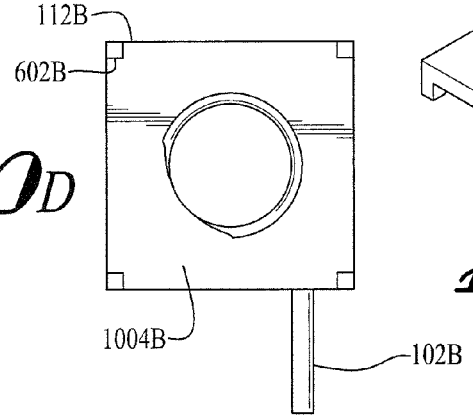
FIG. 10D is a bottom view of the wire coil and mounting plate in FIG. 10A, according to some embodiments of the invention.

The insulator 104B has a first end 802 and a second end 804. The conductive plug 106B has a first end 902 and a second end 904. The second end 804 of the insulator 104B is fixedly-attached to the first end 902 of the conductive plug 106B. The second end 804 of the insulator 104B is configured for mating engagement with the first end 902 of the conductive plug 106B by inserting the second end of the insulator into a slot 908 (FIGS. 9A, 9B, & 9D) of the conductive plug. The attachment can be made permanent with the addition of adhesive. Likewise, the attachment may be removably-attached using a pin and slot connection or a spring-loaded pin. FIGS. 9B through 9D depict a hole 906 in the conductive plug 106B. The hole 906 was included in the conductive plug 106B for pressure relief to allow excess adhesive to spill out in embodiments where the insulator 104B was secured to the conductive plug 104B by adhesive.

The first end 802 of the insulator 104B is an actuator having a key slot 110B. In some embodiments, the actuator is an adjustment tab 110B, while other actuation methods are also possible including, but not limited to, a hand or machine turn-able bolt. The insulator 104B is configured to provide stand-off voltage between each of the plurality of windings of the wire coil 102B.

When the first end 802 of the insulator 104B is actuated, the core (104B/106B) is adjustable. The adjustment causes the insulator 104B and the conductive plug 106B to move in and out of the plurality of windings of the wire coil 102B.

Figures 12A, 12B, 12C:
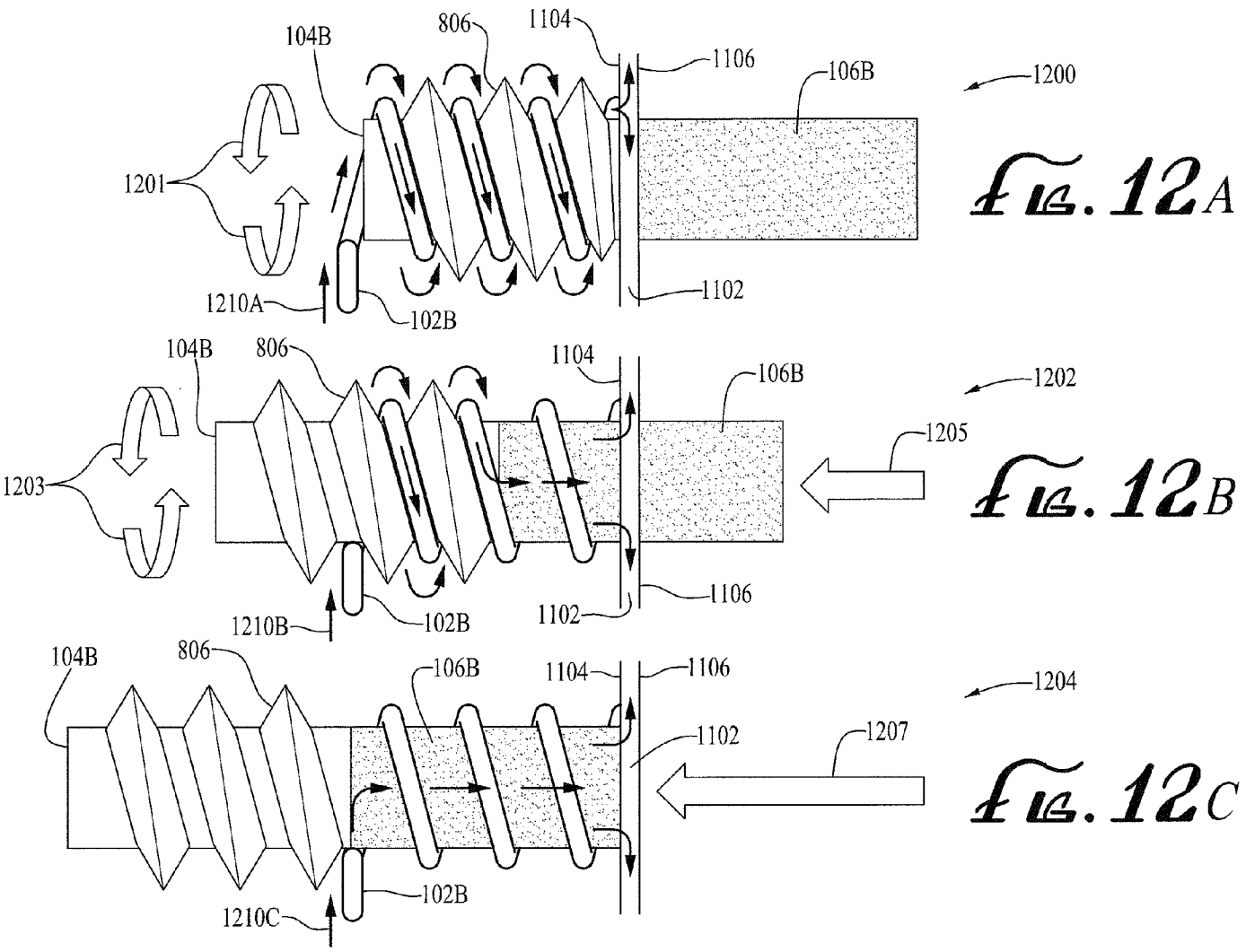
FIG. 12A illustrates a first position of an apparatus, according to some embodiments of the invention.
FIG. 12B illustrates a second position of an apparatus, according to some embodiments of the invention.
FIG. 12C illustrates a third position of an apparatus, according to some embodiments of the invention.

The core (104B/106B) is configured to be disposed in the plurality of windings of the wire coil 102B. One having ordinary skill in the art will recognize that disposed means to be arranged in a particular order. When disposed, the core (104B/106B) has at least three positions in reference to the conductive plate 1102. The conductive plate 1102 may be considered the zero reference mark. The three positions are a first, second, and third position. FIGS. 12A, 12B, & 12C depict exaggerated views of the first, second, and third positions, respectively, to assist with understanding the use of the apparatus 100B. For ease of viewing, the plurality of grooves 910 for the conductive plug 106B is not depicted in FIGS. 12A, 12B, & 12C. Likewise, FIGS. 12A, 12B, & 12C are shown without the mounting plate 112B for ease of viewing. Additionally, the conductive plug 106B is shown with a patterned representation for ease of viewing and should not be construed as being a material different than described or being a section view of the conductive plug.

In FIG. 12A, the first position 1200 is maximum induction for the wire coil 102B. The maximum inductance occurs in the first position 1200 because the insulator is completely disposed (resides inside of) in the wire coil 102B. All of the grooves 806 of the insulator 104B are threaded into the plurality of windings of the wire coil 102B. Likewise, in the first position 1200, the entire length of conductive plug 106B is on the second side 1106 of the conductive plate 1102.

In FIG. 12B, the second position 1202 is the intermediate or medium inductance for the wire coil 102B. The intermediate inductance corresponds to the second position 1202. The second position 1202 occurs when the insulator 104B is partially disposed in the wire coil 102B. In the second position 1202, about one-half of the grooves 806 of the insulator 104B are threaded into the plurality of windings of the wire coil 102B. Additionally, in the second position 1202, about one-half of the conductive plug 106B is on the second side 1106 of the conductive plate 1102.

In FIG. 12C, the third position 1204 is the minimum inductance for the wire coil 102B. The minimum inductance occurs when the conductive plug 106B is entirely disposed in the wire coil 102B. In the third position 1204, all of the grooves 806 of the conductive plug 106B are threaded into the plurality of windings of the wire coil 102B. Thus, the third position 1204 disposes the entire conductive plug 106B on the first side 1104 of the conductive plate 1102.

Both First & Second Embodiments

In some embodiments, the conductive plate 1102 is an electrical plane. In other embodiments, the conductive plate 1102 is a signal plane. The wire coil 102A/102B is conductive. Likewise, the mounting plate 112A/112B is conductive. The second portion (conductive plug) 104B is also conductive. The first portion of the core (the insulator) 104A is non-conductive.

The aperture of the conductive plate 1102 is configured to threadingly-associate with the plurality of grooves 302/806 of the first portion (the insulator) 104A/104B and the second portion (the conductive plug) 106A/106B of the core. In embodiments employing the mounting plate 112A/112B, the conductive plate 1102 and the aperture of the mounting plate have threaded portions configured to threadingly-associate with the plurality of grooves 306/806 & 506/910 on both the insulator 104A/104B and conductive plug 106A/106B.

As depicted in FIGS. 6A, 6B, 7B 10A, 10B, 10D, & 10E, the mounting plate 112A/112B is shown with four prongs 602A/602B. The prongs 602A/602B are legs that are configured to interface with the conductive plate 1102 by seating the mounting plate 112A/112B in the conductive plate, by welding, or by soldering. Alternatively, the mounting plate 112A/112B may also have no prongs/legs, in which case the mounting plate is attached secured directly to the conductive plate 1102, such as by screws, bolts, or other attachment mechanisms known in the art.

Theory of Operation

FIGS. 12A, 12B, & 12C also generically illustrate the theory of operation of embodiments of the invention. Reference characters coincide with the second embodiment (second prototype), however the concepts are equally applicable to the first embodiment (first prototype), also. Embodiments of the invention provide for a method of varying inductance. In FIG. 12A, the first position 1200 is maximum induction for the wire coil 102B. The maximum inductance occurs in the first position because the insulator is completely disposed (resides inside of) in the wire coil 102B. All of the grooves 806 of the insulator 104B are threaded into the plurality of windings of the wire coil 102B. Likewise, in the first position 1200, the entire length of conductive plug 106B is on the second side 1106 of the conductive plate 1102. Maximum inductance is present because the insulator 104B occupies the windings of the wire coil 102B and the current 1210A flows around every coil. At maximum inductance, the conductive plug 106B is unused and hangs out of the wire coil 102B, which can introduce unwanted parasitical electrical properties such as, for example, coupling and parasitic capacitance. To minimize these unwanted parasitical electrical properties, the wire coil 102B is mounted in an electrical plane (the conductive plate 1102) to shield the wire coil from the conductive plug 106B.

Twisting (actuating) the insulator 104B is shown with reference characters 1201 and 1203, resulting in the position changes shown with the arrows (reference characters 1205 and 1207) when the insulator 104B and conductive plug 106B are viewed from the reference of the conductive plate 1102. In FIG. 12B, the second position 1202 is the intermediate or medium inductance for the wire coil 102B. The intermediate inductance corresponds to the second position 1202. The second position 1202 occurs when the insulator 104B is partially disposed in the wire coil 102B. As can be seen in FIG. 12B, about one-half of the grooves 806 of the insulator 104B are threaded into the plurality of windings of the wire coil 102B. Additionally, in the second position 1202, about one-half of the conductive plug 106B is on the second side 1106 of the conductive plate 1102.

The twisting of the insulator 104B pulls the conductive plug 106B through the plane defined by the conductive plate 1102 and into the wire coil's plurality of windings 102B. Some of the current 1210B flows around the wire coil 102B and some current flows directly through the conductive plug 106B. In this orientation, about one-half of the wire coil 102B behaves like an inductor over the portion having current 1210B flowing through the coils. For the other half of the wire coil 102B, little or no inductance is present because the conductive plug 106B electrically shorts the windings of the wire coil 102B which causes current 1210B to flow directly through the conductive plug 106B, avoiding the remaining windings in the wire coil 102B, and then into the conductive plate 1102.

In FIG. 12C, the third position 1204 is the minimum inductance for the wire coil 102B. The minimum inductance occurs when the conductive plug 106B is entirely disposed in the wire coil 102B. This occurs by twisting the insulator 104B so that the conductive plug 106B fully occupies the wire coil 102B. In the third position 1204, all of the grooves 806 of the conductive plug 106B are threaded into the plurality of windings of the wire coil 102B. Thus, the third position 1204 disposes the entire conductive plug 106B on the first side 1104 of the conductive plate 1102, resulting in minimum inductance because all of the windings of the wire coil 102B are electrically shorted and all current 1210C flows directly through the conductive plug 106B.

Therefore, a person having ordinary skill in the art will recognize that, for all embodiments, the insulator 104A/104B is shaped to provide stand-off voltage or insulation between the windings of the coil 102A/102B and to act as a screw-like mechanical device such that when it is twisted, it will move in or out of the wire coil (depending on the direction it is twisted). As such, the apparatus 100A/100B can be returned to maximum inductance (if at minimum inductance) by reversing the direction of twisting. Due to the screw-like construction of the apparatus 100A/100B, it can repeatedly be fluctuated (varied) between minimum and maximum inductance, or set to any desired inductance in-between. Additionally, the apparatus 100A/100B may be manually-actuated or machine-actuated/automatically-actuated without detracting from the merits and generalities of embodiments of the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of assembling a high voltage standoff adjustable inductor configured for a high power input voltage up to about 70 kV, comprising:

providing a conductive plate having a first side, a second side, and an aperture extending through both said first side and said second side, said aperture having a threaded portion;

providing a mounting plate having a first side, a second side, and a threaded aperture extending through said mounting plate;

aligning said aperture of said mounting plate with said aperture of said conductive plate and attaching said second side of said mounting plate to said first side of said conductive plate;

providing a wire coil having a plurality of windings, said plurality of windings having a radius about equal to the radius of said aperture of said mounting plate;

aligning said wire coil on said first side of said mounting plate with said aperture of said mounting plate by positioning said wire coil circumferentially about said aperture of said mounting plate, and attaching said wire coil to said first side of said mounting plate;

providing a non-ferromagnetic core having an insulator portion and a conductive plug portion, wherein each of said insulator portion and said conductive plug portion are configured with a plurality of grooves for threading engagement with said plurality of windings of said wire coil, said insulator portion having a first end and a second end, said conductive plug portion having a first end and a second end, wherein the ratio of the diameter of said insulator portion and the diameter of said conductive plug portion is at least a 3:1 ratio;

attaching said second end of said insulator portion to said first end of said conductive plug portion;

wherein said aperture of said conductive plate and said aperture of said mounting plate have threaded portions configured to threadingly associate with said plurality of grooves on both of said insulator portion and said conductive plug portion;

aligning said first end of said insulator portion with said aperture of said conductive plate on said second side of said conductive plate; and threading said first end of said insulator portion of said non-ferromagnetic core into and through said aperture of said conductive plate, into said aperture of said mounting plate, and into said plurality of said grooves of said wire coil.

2. The method according to claim 1, wherein said first end of said insulator portion is configured to actuate said non-ferromagnetic core when rotated, wherein said non-ferromagnetic core is adjustable when said insulator portion is rotated, said adjustment causing said insulator portion and said conductive plug portion to threadingly-engage with said plurality of windings of said wire coil, said threading engagement causing said insulator and said conductive plug portion to move longitudinally in and out of said plurality of windings of said wire coil.

3. The method according to claim 2, wherein said non-ferromagnetic core is configured to be disposed in said plurality of windings of said wire coil, wherein when disposed, said non-ferromagnetic core having at least three positions in reference to said conductive plate, said at least three positions being a first position, a second position, and a third position, said positions comprising:

a maximum inductance for said wire coil, said maximum inductance corresponding to said first position, said first position occurring when said insulator is completely disposed in said wire coil, wherein all of said plurality of grooves of said insulator are threaded into said plurality of windings of said wire coil, wherein said first position disposing all of said conductive plug on said second side of said conductive plate;

an intermediate inductance for said wire coil, said intermediate inductance corresponding to said second position, said second position occurring when said insulator is partially disposed in said wire coil, wherein about one-half of said plurality of grooves of said insulator are threaded into said plurality of windings of said wire coil, wherein said second position disposing about one-half of said conductive plug on said second side of said conductive plate; and a minimum inductance for said wire coil, said minimum inductance corresponding to said third position, said third position occurring when said conductive plug is entirely disposed in said wire coil, wherein all of said plurality of grooves of said conductive plug are threaded into said plurality of windings of said wire coil, wherein said third position disposing all of said conductive plug on said first side of said conductive plate.

4. The method according to claim 1, wherein said conductive plate is an electrical plane.

5. The method according to claim 1, wherein said conductive plate is a signal plane.

6. The method according to claim 1, wherein said mounting plate is conductive, said wire coil is conductive, and said insulator is non-conductive.

7. A method of varying inductance with a high voltage standoff adjustable inductor, said method, comprising:

providing an inductor, said inductor, comprising:

a conductive plate having a first side, a second side, and an aperture extending through both said first side and said second side, said aperture having a threaded portion;

a wire coil mounted on said first side of said conductive plate, wherein said wire coil has a plurality of windings, said wire coil having a first end and a second end, wherein said first end of said wire coil is configured for an input voltage and said second end of said wire coil is mounted to said first side of said conductive plate; and a non-ferromagnetic core having an insulator portion and a conductive plug portion, wherein each of said insulator portion and said conductive plug portion are configured with a plurality of grooves for threading engagement with said plurality of windings of said wire coil, said threading engagement attaching said non-ferromagnetic core to said plurality of windings of said wire coil, said insulator portion having a first end and a second end, said conductive plug portion having a first end and a second end, wherein the ratio of the diameter of said insulator portion and the diameter of said conductive plug portion is at least a 3:1 ratio;

inputting a high power voltage up to about 70 kV to said first end of said wire coil; and varying inductance by rotating said non-ferromagnetic core.

8. The method according to claim 7, wherein said first end of said insulator portion is configured to actuate said non-ferromagnetic core when rotated, wherein said non-ferromagnetic core is adjustable when said insulator portion is rotated, said adjustment causing said insulator portion and said conductive plug portion to threadingly-engage with said plurality of windings of said wire coil, said threading engagement causing said insulator portion and said conductive plug portion to move longitudinally in and out of said plurality of windings of said wire coil, said longitudinal movement corresponding to a varied inductance of said inductor.

9. The method according to claim 8, wherein said non-ferromagnetic core is configured to be disposed in said plurality of windings of said wire coil, wherein when disposed, said non-ferromagnetic core having at least three positions in reference to said conductive plate, said at least three positions being a first position, a second position, and a third position, said positions comprising:

a maximum inductance for said wire coil, said maximum inductance corresponding to said first position, said first position occurring when said insulator portion is completely disposed in said wire coil, wherein all of said plurality of grooves of said insulator portion are threaded into said plurality of windings of said wire coil, wherein said first position disposing all of said conductive plug portion on said second side of said conductive plate;

an intermediate inductance for said wire coil, said intermediate inductance corresponding to said second position, said second position occurring when said insulator portion is partially disposed in said wire coil, wherein about one-half of said plurality of grooves of said insulator portion are threaded into said plurality of windings of said wire coil, wherein said second position disposing about one-half of said conductive plug portion on said second side of said conductive plate; and a minimum inductance for said wire coil, said minimum inductance corresponding to said third position, said third position occurring when said conductive plug portion is entirely disposed in said wire coil, wherein all of said plurality of grooves of said conductive plug portion are threaded into said plurality of windings of said wire coil, wherein said third position disposing all of said conductive plug portion on said first side of said conductive plate.

10. The method according to claim 7, wherein said conductive plate is an electrical plane.

11. The method according to claim 7, wherein said conductive plate is a signal plane.

12. The method according to claim 7, wherein said wire coil is conductive and said insulator portion is non-conductive.

* * * * *